US009104182B2

(12) United States Patent
Honda et al.

(10) Patent No.: US 9,104,182 B2
(45) Date of Patent: Aug. 11, 2015

(54) ELECTRONIC TIMEPIECE AND ELECTRONIC DEVICE

(75) Inventors: Katsuyuki Honda, Nagano-ken (JP); Norimitsu Baba, Nagano-ken (JP); Jun Matsuzaki, Nagano-ken (JP); Toshikazu Akiyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 433 days.

(21) Appl. No.: 13/594,244

(22) Filed: Aug. 24, 2012

(65) Prior Publication Data

US 2013/0051186 A1 Feb. 28, 2013

(30) Foreign Application Priority Data

Aug. 30, 2011 (JP) ..... 2011-187478

(51) Int. Cl.
*G04R 20/02* (2013.01)
*G04R 20/04* (2013.01)
*G04G 5/00* (2013.01)

(52) U.S. Cl.
CPC *G04R 20/04* (2013.01); *G04G 5/00* (2013.01); *G04R 20/02* (2013.01)

(58) Field of Classification Search
CPC ..... G04R 20/00; G04R 20/02; G04G 21/08; G04G 5/00
USPC ..... 368/47
See application file for complete search history.

(56) References Cited

U.S. PATENT DOCUMENTS

| | | | | |
|---|---|---|---|---|
| 5,724,316 | A * | 3/1998 | Brunts | 368/10 |
| 7,932,856 | B2 * | 4/2011 | Baba | 342/357.25 |
| 2007/0056117 | A1 * | 3/2007 | Gardiner et al. | 7/119 |
| 2009/0189809 | A1 * | 7/2009 | Baba | 342/357.12 |
| 2010/0057349 | A1 | 3/2010 | Akiyama | |
| 2010/0220555 | A1 * | 9/2010 | Honda | 368/14 |

FOREIGN PATENT DOCUMENTS

| | | | |
|---|---|---|---|
| JP | 07-325168 | A | 12/1995 |
| JP | 2004-325331 | A | 11/2004 |
| JP | 2008-304364 | A | 12/2008 |
| JP | 2010-078546 | | 4/2010 |

* cited by examiner

*Primary Examiner* — Sean Kayes

(57) ABSTRACT

An electronic timepiece enables a simple construction, and an electronic device has the electronic timepiece. A wristwatch 1 has a button A 6; a mode setting unit 32 that sets the operating mode of the wristwatch 1 based on an input operation of the button A 6. Based on the continuous input time that the button A 6 is operated continuously, the mode setting unit 32 changes the operating mode between a timekeeping mode that receives satellite signals from one or more GPS satellites and adjusts the internal time information based on time information contained in a received satellite signal; and a positioning mode that receives satellite signals from three or more GPS satellites and adjusts the internal time information based on time information and positioning information contained in the received satellite signals.

6 Claims, 5 Drawing Sheets

ELECTRONIC TIMEPIECE AND ELECTRONIC DEVICE

BACKGROUND

1. Technical Field

The present invention relates to an electronic timepiece that receives signal transmitted from GPS satellites or other positioning information satellites, and to an electronic device having the electronic timepiece.

2. Related Art

GPS satellites with known orbits around the Earth are used in the GPS system, which is a system for determining one's position, and each GPS satellite carries an atomic clock. Each GPS satellite therefore also keeps extremely precise time information (also referred to as the GPS time or satellite time).

Electronic timepieces that use time information contained in navigation data sent from GPS satellites to correct internal time information kept by a timekeeping means are known from the literature. See, for example, Japanese Unexamined Patent Appl. Pub. JP-A-2010-78546.

JP-A-2010-78546 describes a configuration that can change between a timekeeping mode that adjusts the internal time information based on a satellite signal from at least one GPS satellite, and a positioning mode that calculates the current location (position) based on satellite signals received from a plurality of GPS satellites and adjusts the time difference of the internal time information accordingly. Using the crown or two buttons to switch between these modes is also described.

If one function is assigned to one operating device (such as a button) on an electronic timepiece, the same number of operating devices as electronic timepiece functions must be provided. With JP-A-2010-78546, therefore, one button is pressed to enter the timekeeping mode, and another button is pressed to enter the positioning mode. If the electronic timepiece has other functions such as a time adjustment function or a calendar display function that are accessed by operating a button, even more buttons or other operating devices must be provided, and the configuration becomes increasingly complex.

SUMMARY

An object of the present invention is to provide an electronic timepiece with a simplified configuration, and an electronic device.

One aspect of the invention is an electronic timepiece adjusts internal time information based on a satellite signal transmitted from a positioning information satellite, and includes: an external operating member; a mode setting unit that sets an operating mode of the timepiece based on an input operation of the external operating member; a reception unit that receives the satellite signal transmitted from the positioning information satellite; a reception control unit that controls operation of the reception unit and receives the satellite signal based on the operating mode; and a time adjustment unit that adjusts the internal time information based on the satellite signal received by the reception unit; wherein based on a continuous input time for which the external operating member is operated continuously, the mode setting unit changes and sets the operating mode to a first mode that receives a satellite signal from one or more positioning information satellites and adjusts the internal time information based on time information contained in the received satellite signal, or a second mode that receives satellite signals from three or more positioning information satellites and adjusts the internal time information based on time information and positioning information contained in the received satellite signals.

The continuous input time is the time from when the input operation of the external operating member starts until the input operation stops. When the external operating member is a button that is pressed on to input, for example, the continuous input time indicates the time that the button is pressed continuously (the time from when the button is depressed until the button is released).

The mode setting unit switches the operating mode between a first mode and a second mode according to the continuous input time that the external operating member is operated.

The first mode is a mode that adjusts the time based on time information contained in satellite signals from one or more positioning information satellites. The satellite signals received in this first mode may be satellite signals from only one positioning information satellite. This first mode can therefore adjust the internal time even in environments where reception sensitivity is poor. The second mode requires satellite signals from at least three positioning information satellites, however, and highly precise time adjustment using both time information and positioning information contained in the received satellite signals is therefore possible.

Because the invention enables switching the first mode and second mode according to the continuous input time of a single external operating member, providing a plurality of external operating members corresponding to the individual operating modes in order to execute the process of each operating mode is therefore not necessary, and switching between two modes is therefore possible using a single external operating member. As a result, the invention enables simplifying electronic timepiece construction and reducing electronic timepiece size.

In an electronic timepiece according to another aspect of the invention, the continuous input time when the mode setting unit sets the first mode as the operating mode is preferably shorter than the continuous input time when the mode setting unit sets the second mode as the operating mode.

In this aspect of the invention the continuous input time when the mode setting unit sets the first mode is shorter than the continuous input time when the second mode is set.

Time adjustment with the first mode takes less time than time adjustment in the second mode, and the first mode is therefore generally used more frequently. Because the continuous input time corresponding to the first mode is set shorter than the continuous input time for entering the second mode, this aspect of the invention enables promptly adjusting the time in the more frequently used first mode, and therefore makes the time adjustment process more convenient for the user.

In an electronic timepiece according to another aspect of the invention, when the operating mode set by the mode setting unit is the second mode, the time adjustment unit calculates a standard time at the current location of the electronic timepiece and sets the internal time information based on the time information and positioning information contained in the satellite signals.

In the second mode, the time adjustment unit in this aspect of the invention calculates the current location of the electronic timepiece, calculates the standard time (local time) at that current location, and adjusts the internal time information based on the time information and positioning information contained in the received satellite signals. As a result, the internal time information can be precisely adjusted to the local time at the current location, and electronic timepiece convenience can be improved particularly when travelling between locations in difference time zones.

In an electronic timepiece according to another aspect of the invention, a reception result storage unit that stores a reception result indicating whether or not satellite signal reception by the reception unit succeeded; a reception result display unit that displays the reception result; and a result display control unit that causes the reception result display unit to display the reception result; wherein the mode setting unit sets a third mode that causes displaying the reception result stored in the reception result storage unit based on the continuous input time as the operating mode, and when the third mode is set as the operating mode, the result display control unit displays the reception result on the reception result display unit.

When the reception process is executed by the reception control unit in this aspect of the invention, a reception result indicating whether or not satellite signal reception by the reception unit succeeded is stored in a reception result storage unit. If the mode setting unit sets the operating mode to the third mode based on the continuous input time when the external operating member was operated, the reception result stored in the reception result storage unit is displayed on the reception result display unit by the result display control unit.

This configuration enables the user to easily check whether or not the last reception process was successful. The ease of use of the electronic timepiece can also be improved because the user can easily determine when the time will be adjusted as a result of the reception result being displayed.

Furthermore, because a separate external operating member is not required to display the reception result, the construction of the electronic timepiece can be simplified and the size can be reduced as described above.

In an electronic timepiece according to another aspect of the invention, the continuous input time when the mode setting unit sets the third mode as the operating mode is shorter than the continuous input time when the mode setting unit sets the first mode or the second mode as the operating mode.

When the reception result of the last reception process can be referenced, the user generally determines whether or not to adjust the time after first confirming the reception result. As a result, the third mode, which is used for checking the reception result, is used more frequently than the first mode or the second mode, which are used for adjusting the time.

This aspect of the invention therefore sets the continuous input time for setting the third mode shorter than the continuous input times used to set the first mode or second mode in which the time is adjusted. The user can therefore promptly display the reception result in the frequently used third mode, and the ease of use of the electronic timepiece can be improved.

An electronic timepiece according to another aspect of the invention preferably also has an operating time display unit that displays the operating time that the external operating member is operated continuously.

The operating time as used herein is the time that the external operating member is operated continuously from the start of the input operation without the input operation being cancelled.

The operating time of the external operating member is displayed on the operating time display unit in this aspect of the invention. More specifically, the operating time is displayed on the operating time display unit while the external operating member is operated continuously. The user can therefore easily know the operating time, and can therefore easily check how long the external operating member must be operated continuously to achieve the continuous input time corresponding to the desired operating mode.

An electronic timepiece according to another aspect of the invention preferably also has a set mode display unit that displays the operating mode corresponding to the operating time that the external operating member is operated continuously.

As described above, the operating time as used herein is the time that the external operating member is operated continuously from the start of the input operation without the input operation being cancelled.

This aspect of the invention also displays the operating mode corresponding to the current operating time on the display unit based on the actual operating time from the start of operating the external operating member.

For example, if the continuous input time for setting the first mode is t1 seconds from when operation starts at 0 seconds, and the continuous input time for setting the second mode is t1 seconds or more, that the first mode can be set is displayed on the set mode display unit while the operating time of the external operating member is from 0 to t1 seconds. When the operating time from the start of operating the external operating member is t1 seconds or more, that the second mode can be set is displayed on the set mode display unit.

This configuration enables the user to easily set the desired operating mode by operating the external operating member continuously while checking the operating mode displayed on the set mode display unit.

An electronic timepiece according to another aspect of the invention preferably also has an operation mode display unit that displays the operating mode being executed.

The user can easily check the operating mode of the operation that is currently executing with this aspect of the invention because the current operating mode is displayed in the operation mode display unit while the process corresponding to the operating mode set by the mode setting unit is running.

Another aspect of the invention is an electronic device having the electronic timepiece described above.

This aspect of the invention enables easily changing the operating mode of the electronic timepiece using a single external operating member, thereby simplifying the construction. The construction of an electronic device having this electronic timepiece can therefore also be simplified.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the invention is described below with reference to the accompanying figures.

Electronic Timepiece Configuration

Figure 1:
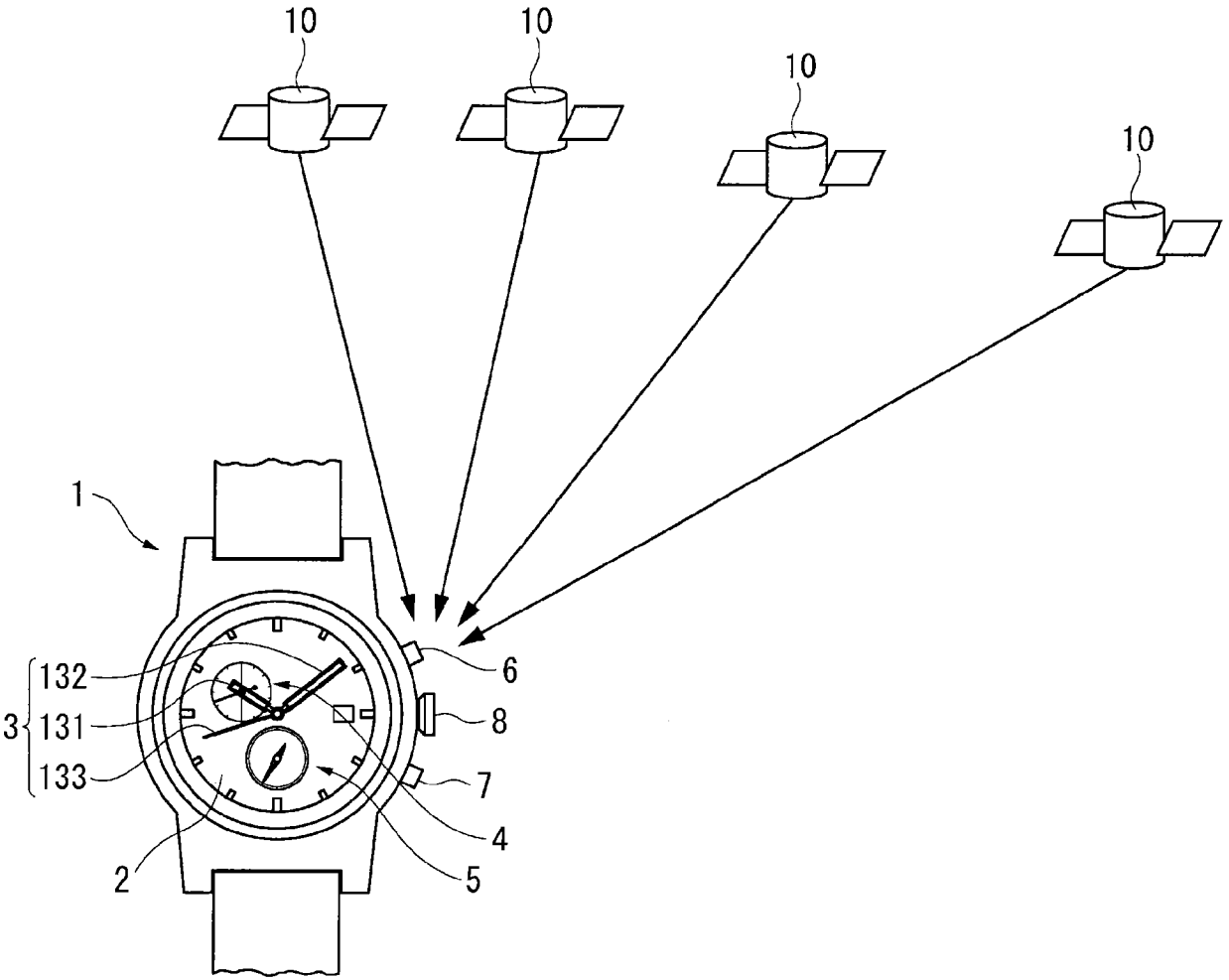
FIG. 1 shows a GPS wristwatch according to a preferred embodiment of the invention.
Figure 2:
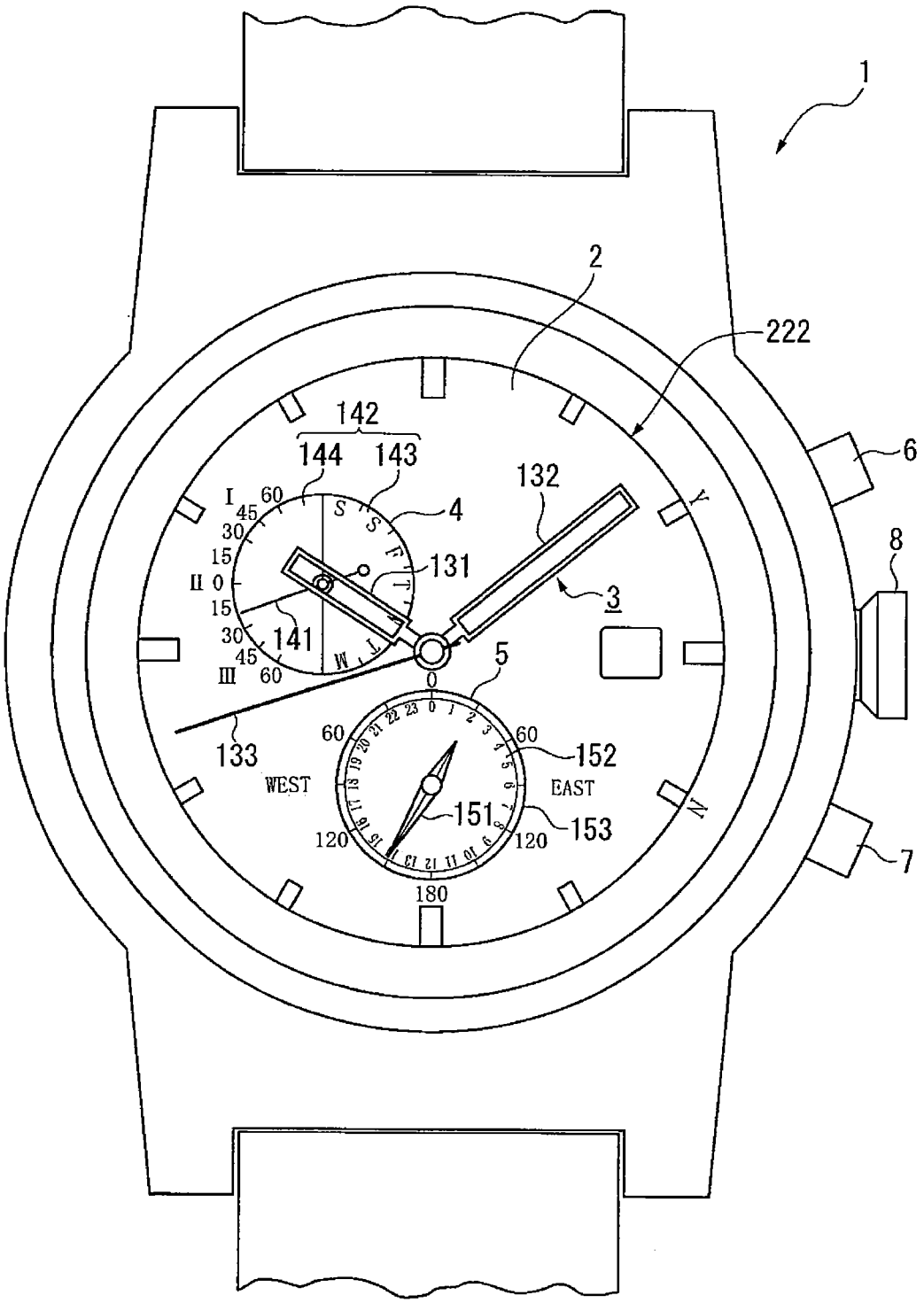
FIG. 2 shows the face of the wristwatch according to this embodiment.

FIG. 1 shows a wristwatch with a GPS time adjustment device 1 (referred to as simply a "wristwatch 1" below) as an example of a timepiece with a time adjustment device according to the invention, and FIG. 2 shows the front of the wristwatch 1.

As shown in FIG. 1, the wristwatch 1 is configured to receive satellite signals and acquire satellite time information from at least one GPS satellite 10 from among a plurality of GPS satellites 10 orbiting the Earth in space on specific orbits, and adjust time information that is kept internally (internal time information or simply the internal time). Note that a GPS satellite 10 is one example of a positioning information satellite as used in this invention, and plural satellites are currently in orbit. Approximately 30 GPS satellites 10 are currently in orbit.

As shown in FIG. 2, this wristwatch 1 has a time display unit including a dial 2 and hands 3, and button A 6, button B 7, and a crown 8 as external operating members of the invention. The hands 3 include an hour hand 131, minute hand 132, and second hand 133, and the hands 3 are driven through a wheel train by a stepper motor or other mechanical drive means.

The dial 2 has markers for indicating the time with the hands 3 as in a common analog timepiece.

As further described below, the dial 2 also has markers for indicating the reception result with the second hand 133. This embodiment has a Y at the 10-second marker position, and an N at the 20-second marker position. The Y is an abbreviation for "yes," and the N is an abbreviation for "no."

The dial 2 also has two subdials 4 and 5. The first subdial 4 is located towards the 10:00 position of the dial 2 relative to the center pivot of the hands 3. The second subdial 5 is located towards the 6:00 position of the dial 2 relative to the center pivot of the hands 3.

The first subdial 4 has a first small hand 141, and a first small dial 142 with markers pointed to by the first small hand 141.

The first small dial 142 is divided into two parts, a first area 143 and a second area 144. More particularly, the first small dial 142 is round and is divided by a vertical line through the center, that is, a line between positions equivalent to the 00:00 position and the 6:00 position of the dial 2, into a first area 143 on the 3:00 side of the dial 2 (the right side of the first small dial 142), and a second area 144 on the 9:00 side of the dial 2 (the left side of the first small dial 142).

Markers indicating the days of the week on set in the first area 143. In this embodiment as shown in FIG. 2, an M for Monday, T for Tuesday, W for Wednesday, T for Thursday, F for Friday, S for Saturday, and S for Sunday are set counterclockwise from the bottom of the first area 143. Note that the S for Saturday could be blue, and the S for Sunday could be red to more clearly differentiate the days.

Markers for latitude are set in the second area 144. In this embodiment as shown in FIG. 2, a marker for 0 degrees latitude is set at the 9:00 position of the first small dial 142, markers for 0-90 degrees north latitude are set clockwise from this position to the 12:00 position of the first small dial 142 (the border between the two areas), and markers for 0-90 degrees south latitude are set counterclockwise from this position to the 6:00 position of the first small dial 142 (the border between the two areas).

Markers for indicating the operating mode of the wristwatch 1 with the first small hand 141 are set in the second area 144. In this embodiment a Roman numeral I is set at the marker indicating 45 degrees north latitude, a II is set at the 0 degree latitude marker, and a III is set at the marker indicating 45 degrees south latitude. The I denotes a reception result display mode, the II denotes the timekeeping mode, and the III denotes the positioning mode. These operating modes are described below.

The second subdial 5 has a second small hand 151, and a second small dial 152 with markers pointed to by the second small hand 151.

A round scale 153 is provided around the second small dial 152. This scale 153 has markers for a 24-hour hand and markers for indicating longitude. More specifically, markers for indicating longitude are provided around the outside of the scale 153, and markers for a 24-hour hand are provided around the inside.

The longitude markers start with 0 degrees longitude at the 12:00 position of the second small dial 152 (the top in FIG. 2), markers for 0-180 degrees east longitude are provided clockwise from the 12:00 position of the second small dial 152 past the 3:00 position to the 6:00 position, and markers for 0-180 degrees east longitude are provided counterclockwise from the 12:00 position of the second small dial 152 past the 9:00 position to the 6:00 position.

The scale for the 24-hour hand has a marker for 00:00 (24:00) at the 12:00 position of the second small dial 152 with markers for 1:00 to 23:00 proceeding clockwise.

The first small hand 141 of the first subdial 4 and the second small hand 151 of the second subdial 5 are driven by separate stepper motors through respective wheel trains.

The display modes of the time display unit of the wristwatch 1 according to this embodiment of the invention are a time display mode, location (positioning) display mode, and operation display mode.

The time display mode is the display mode that displays the time based on the internal time information during normal operation when the buttons 6 and 7 and crown 8 are not operated. In the time display mode, the first small hand 141 of the first subdial 4 moves to the position indicating the weekday of the internal time in the first area 143, and the second small hand 151 of the second subdial 5 moves to the position indicating the hour of the internal time using the 24-hour hand markers of the scale 153.

The location display mode is the display mode entered when the button B 7 is pressed, for example, and is the display mode that displays the latitude and longitude of the current position using the subdials 4 and 5. In the location display mode the first small hand 141 of the first subdial 4 moves to the position indicating the latitude of the acquired current position in the second area 144, and the second small hand 151 of the second subdial 5 moves to the position indicating the longitude of the acquired current position.

The operation display mode is the mode that displays the operating mode of the wristwatch 1 when the button A 6 is pressed. The operation display mode has a reception result display mode, timekeeping mode, and positioning mode as described above. In this operation display mode as described below, the second hand 133 of the hands 3 displays on the dial 2 how long the button A 6 is continuously depressed (how long the input state is not cancelled). The first small hand 141 of the first subdial 4 also moves to the position in the second area 144 indicating the operating mode corresponding to how long the button A 6 remains depressed (operating time, continuous input time).

Wristwatch Circuits

The main circuits of the wristwatch 1 are described next.

Figure 3:
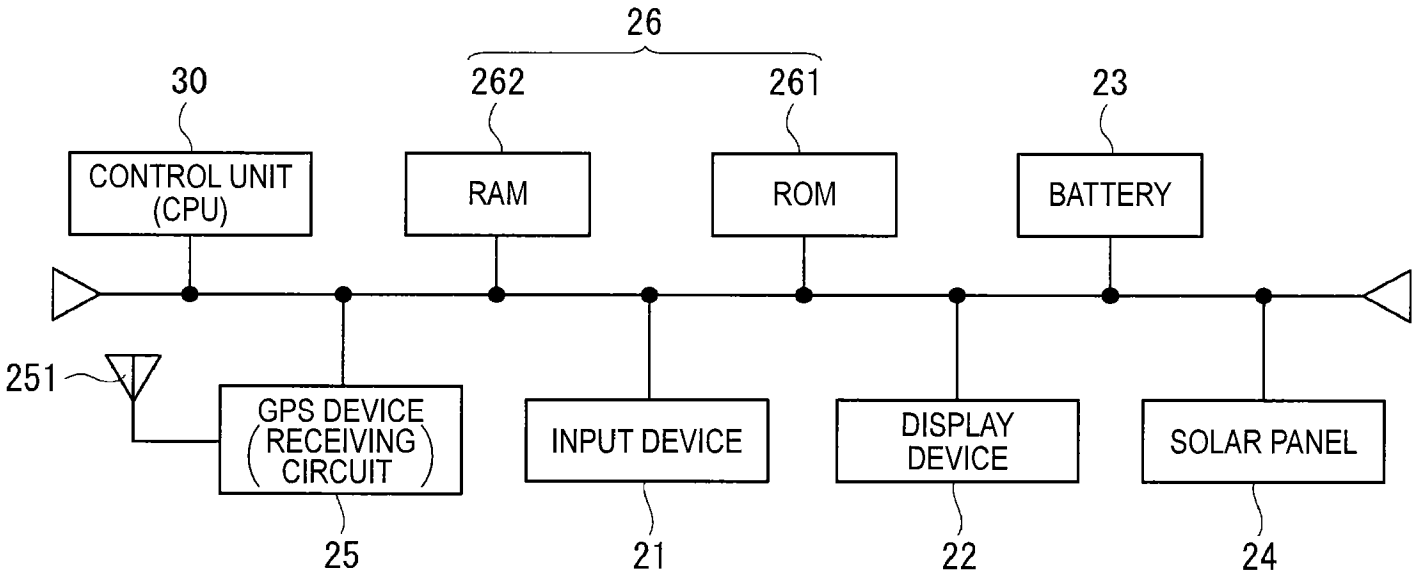
FIG. 3 describes the main hardware configuration of the wristwatch according to this embodiment.

FIG. 3 shows the main hardware configuration of the wristwatch 1.

As shown in FIG. 3, the wristwatch 1 includes an input device 21, display device 22, battery 23, solar panel 24, a GPS device 25 (reception unit), storage device 26, and control unit (CPU) 30.

The input device 21 includes button A 6, button B 7, and the crown 8.

The display device 22 includes a display drive unit 221 and display unit 222. The display drive unit 221 includes mechanical parts (stepper motors and wheel trains) for driving the hands 3, first small hand 141, and second small hand 151, and drive circuits for the stepper motors. The display unit 222 includes the dial 2, hands 3, first subdial 4, and second subdial 5.

The battery 23 is a storage battery, and stores power produced by the solar panel 24. The battery 23 supplies power to the display device 22, GPS device 25, storage device 26, and control unit 30.

The solar panel 24 is disposed to the dial 2, for example, and has a photovoltaic device that produces power by converting light energy to electric energy.

Configuration of the GPS Device

The GPS device 25 includes a GPS antenna 251. While not shown in the figures, the GPS device 25 includes an RF (radio frequency) unit that receives and converts satellite signals sent from the GPS satellites to digital signals; a baseband unit that performs a correlation process to synchronize with the received signals; and an information acquisition unit that acquires time information and positioning information from the navigation message (satellite signal) demodulated by the baseband unit.

The RF unit includes a bandpass filter, PLL circuit, IF filter, VCO (voltage controlled oscillator), A/D converter, mixer, LNA (low noise amplifier), and IF amplifier.

Satellite signals extracted by the bandpass filter are amplified by the LNA and mixed with the VCO signal by the mixer, and then down-converted to an IF (intermediate frequency) signal. The IF signal mixed by the mixer passes through an IF amplifier and IF filter, and is converted to a digital signal by the A/D converter.

The baseband unit includes a local code generator and a correlation unit. The local code generator generates a local code that is identical to the C/A code used by the GPS satellite for signal transmission. The correlation unit calculates the correlation between this local code and the reception signal output from the RF unit.

If the correlation value calculated by the correlation unit is greater than or equal to a specific threshold value, the local code matches the C/A code used in the received satellite signal, and locking onto (synchronization with) the satellite signal is possible. As a result, the navigation message can be demodulated by applying a correlation process to the received satellite signal using the local code.

The data acquisition unit acquires the time information and positioning information from the navigation message demodulated by the baseband unit. More specifically, the navigation messages sent from the GPS satellites include preamble data and the TOW (Time of Week, also called the Z count) of the HOW (Handover Word), and subframe data. The subframe data includes subframes 1 to 5, and each subframe contains, for example, satellite correction data such as the week number and satellite health data, ephemeris (detailed orbit information for a particular GPS satellite), and almanac data (orbit information for all GPS satellites).

The data acquisition unit extracts specific data from the received navigation message, and acquires the time information and positioning information.

Storage Device Configuration

The storage device 26 includes ROM 261 and RAM 262.

A program run by the control unit 30 is stored in ROM 261.

The satellite signal acquired by the reception process, the time information and reception result described below, and the location information calculated by a positioning operation when signals are received in the positioning mode, are stored in RAM 262.

RAM 262 therefore includes a time information memory unit 263 that stores the time information acquired from received signals, and a reception result memory unit 264 that stores reception result information indicating if reception was successful, and the time reception started.

Control Unit Configuration

Figure 4:
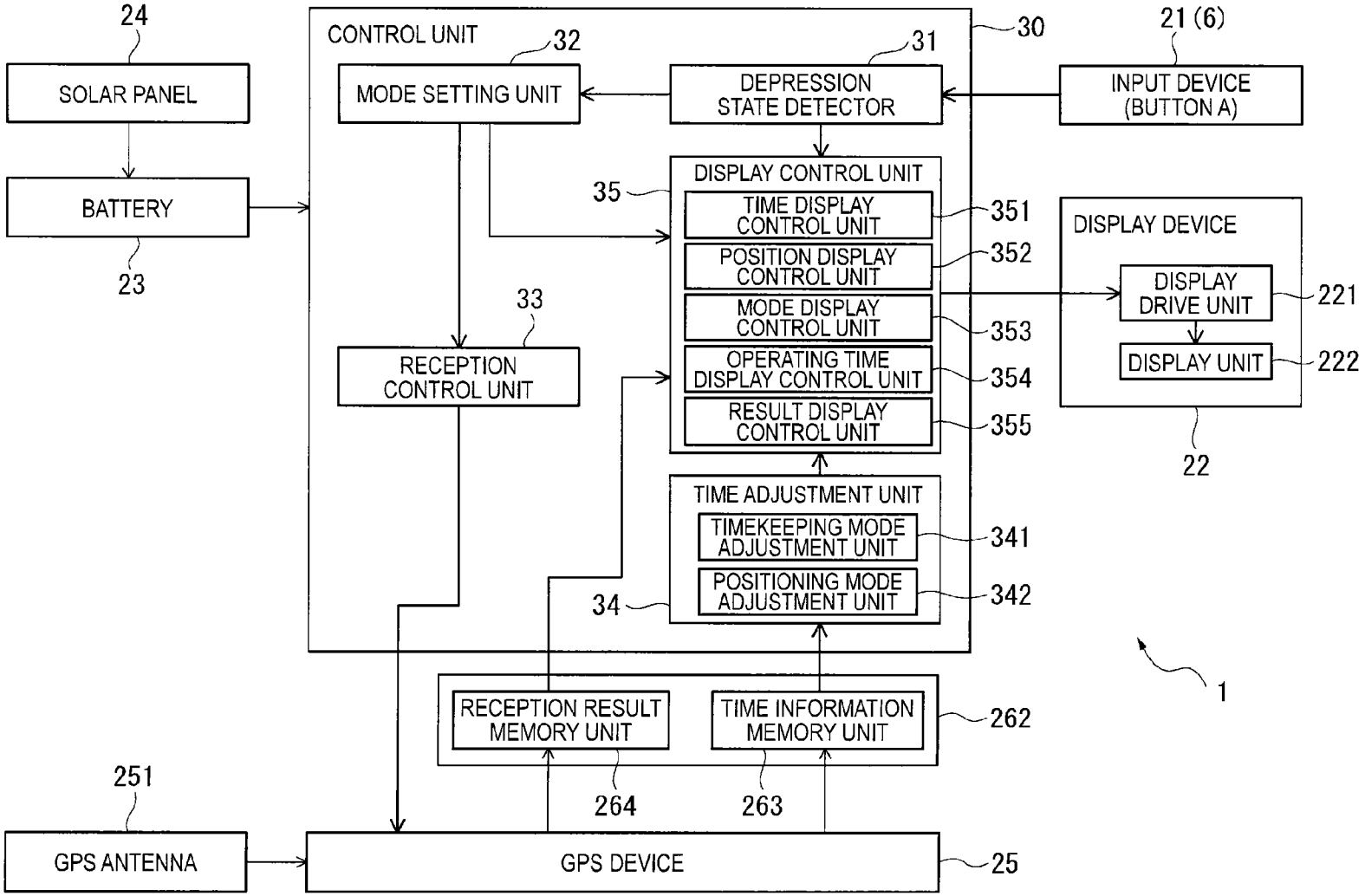
FIG. 4 is a block diagram of the main system configuration of the wristwatch according to this embodiment.

FIG. 4 is a function block diagram showing the configuration of the wristwatch 1.

The control unit 30 (CPU) controls the GPS device 25, and corrects the time information based on the acquired time information.

The control unit 30 controls operation based on a program stored in ROM 261. As shown in FIG. 4, the control unit 30 therefore functions as a depression state detector 31, mode setting unit 32, reception control unit 33, time adjustment unit 34, and display control unit 35.

The depression state detector 31 determines whether or not button A 6, an external operating member, is being pressed.

When the depression state detector 31 determines that button A 6 is depressed, the mode setting unit 32 counts the operating time that the button A 6 is continuously depressed. When the button A 6 is then released, the mode setting unit 32 then acquires the operating time until the button was released as the continuous input time.

The mode setting unit 32 then sets the operating mode of the wristwatch 1 based on the continuous input time. As described above, the operating modes that can be set for the wristwatch 1 in this embodiment are the reception result display mode (the third mode in the accompanying claims), the timekeeping mode (the first mode in the accompanying claims), and the positioning mode (the second mode in the accompanying claims).

The reception result display mode is the operating mode that displays the reception result stored in the reception result memory unit 264 on the display unit 222. More specifically, the last reception result is displayed by the dial 2 and second hand 133 in the reception result display mode.

The timekeeping mode is the operating mode that gets the time information from the satellite signals transmitted from one or more GPS satellites 10 and adjusts the internal time information based on the acquired time information.

The positioning mode is the operating mode that gets time information and positioning information from the satellite signals transmitted from three or more GPS satellites 10, calculates the local time, and adjusts the internal time information.

More specifically, when the continuous input time T is $0<T<=T1$ (first input period), the mode setting unit 32 sets the operating mode to the reception result display mode.

When the continuous input time T is $T1<T<=T2$ (second input period), the mode setting unit 32 sets the operating mode to the timekeeping mode.

When the continuous input time T is $T2<T$ (third input period), the mode setting unit 32 sets the operating mode to the positioning mode.

If button A 6 is not released and the operating time exceeds time T2, the mode setting unit 32 in this embodiment determines the continuous input time T is $T2<T$ and sets the operating mode to the positioning mode.

The times T1 and T2 for determining the operating mode are not particularly limited, and in this embodiment time T1 is set to 3 seconds, and time T2 is set to 6 seconds, for example.

When the operating mode is set to the timekeeping mode or positioning mode by the mode setting unit 32, the reception control unit 33 controls the satellite signal reception process of the GPS device 25 according to the selected operating mode. More specifically, when the timekeeping mode is set, the reception control unit 33 drives the GPS device 25 to receive a satellite signal from one or more GPS satellites 10. When the positioning mode is set, the reception control unit 33 drives the GPS device 25 to receive satellite signals from three or more GPS satellites 10.

The time adjustment unit 34 adjusts the internal time information based on the satellite signal positioning information and time information acquired in the reception process by the reception control unit, and includes a timekeeping mode adjustment unit 341 and a positioning mode adjustment unit 342.

When the timekeeping mode is set by the mode setting unit 32, the timekeeping mode adjustment unit 341 adjusts the internal time information based on the time information contained in the satellite signal acquired by the GPS device 25. Note that a satellite signal must be acquired from at least one GPS satellite 10 for the timekeeping mode adjustment unit 341 to adjust the time.

When the positioning mode is set by the mode setting unit 32, the positioning mode adjustment unit 342 gets the positioning information and time information contained in the satellite signals acquired by the GPS device 25, and gets the time difference at the current location based on the positioning information by referencing the time difference information stored in the ROM 261. The positioning mode adjustment unit 342 calculates the standard time at the current location (local time) based on the acquired time information and time difference, and adjusts the internal time information. Time adjustment in the positioning mode adjustment unit 342 enables adjusting the time with high precision because the internal time information is adjusted based on satellite signals from three or more GPS satellites 10.

The display control unit 35 includes a time display control unit 351, position display control unit 352, mode display control unit 353, operating time display control unit 354, and result display control unit 355.

The time display control unit 351 drives the display drive unit 221 based on the internal time information, and displays the time in the normal time display mode on the display unit 222.

When an operation for displaying the positioning information, such as pressing button B 7, is performed, the position display control unit 352 drives the display drive unit 221 and displays the current position (latitude and longitude) calculated by the positioning mode adjustment unit 342 in the first subdial 4 and second subdial 5. When the positioning mode is set by the mode setting unit 32 and the reception process of the reception control unit 33 ends, the position display control unit 352 may also display the positioning information for a specific time.

When button A 6 is pressed, the mode display control unit 353 drives the first small hand 141 of the first subdial 4 according to the operating time that the button A 6 was pressed continuously, and displays the operating mode corresponding to the operating time. This operating time indicates the time from when pressing the button A 6 started to the current time without the button A 6 being released.

When the button A 6 is released and the process corresponding to the selected mode is performed, the mode display control unit 353 holds the first small hand 141 of the first subdial 4 at the same position while that operating mode continues. In other words, the mode display control unit 353 causes the first small hand 141 of the first subdial 4 to indicate the same operating mode for as long as the wristwatch 1 is executing the operating process of the operating mode set by the mode setting unit 32.

More specifically, the first subdial 4 in this embodiment functions as the set mode display unit and the operating mode display unit in the accompanying claims as control led by the mode display control unit 353.

When the button A 6 is pressed, the operating time display control unit 354 moves the second hand 133 of the hands 3 to the 00:00 position and moves the second hand 133 each second according to the operating time.

When the reception result display mode is set by the mode setting unit 32, the result display control unit 355 moves the second hand 133 to the Y or the N marker on the dial 2 according to the reception result stored in the reception result memory unit 264.

More specifically, the dial 2 and hands 3 (second hand 133) function as the operating time display unit in the accompanying claims when controlled by the operating time display control unit 354, and function as the reception result display unit in the accompanying claims when controlled by the result display control unit 355.

Note that in this embodiment the display control unit 35 displays the time, displays the operating mode, and displays the operating time with hands, but a display panel, for example, could be used as the display unit 222 and the same content presented on the display panel. In this case the display device 22 also has a circuit for driving the display panel.

Control Circuit Operation

Wristwatch 1 operation is described next with reference to the flow chart in FIG. 5.

Figure 5:
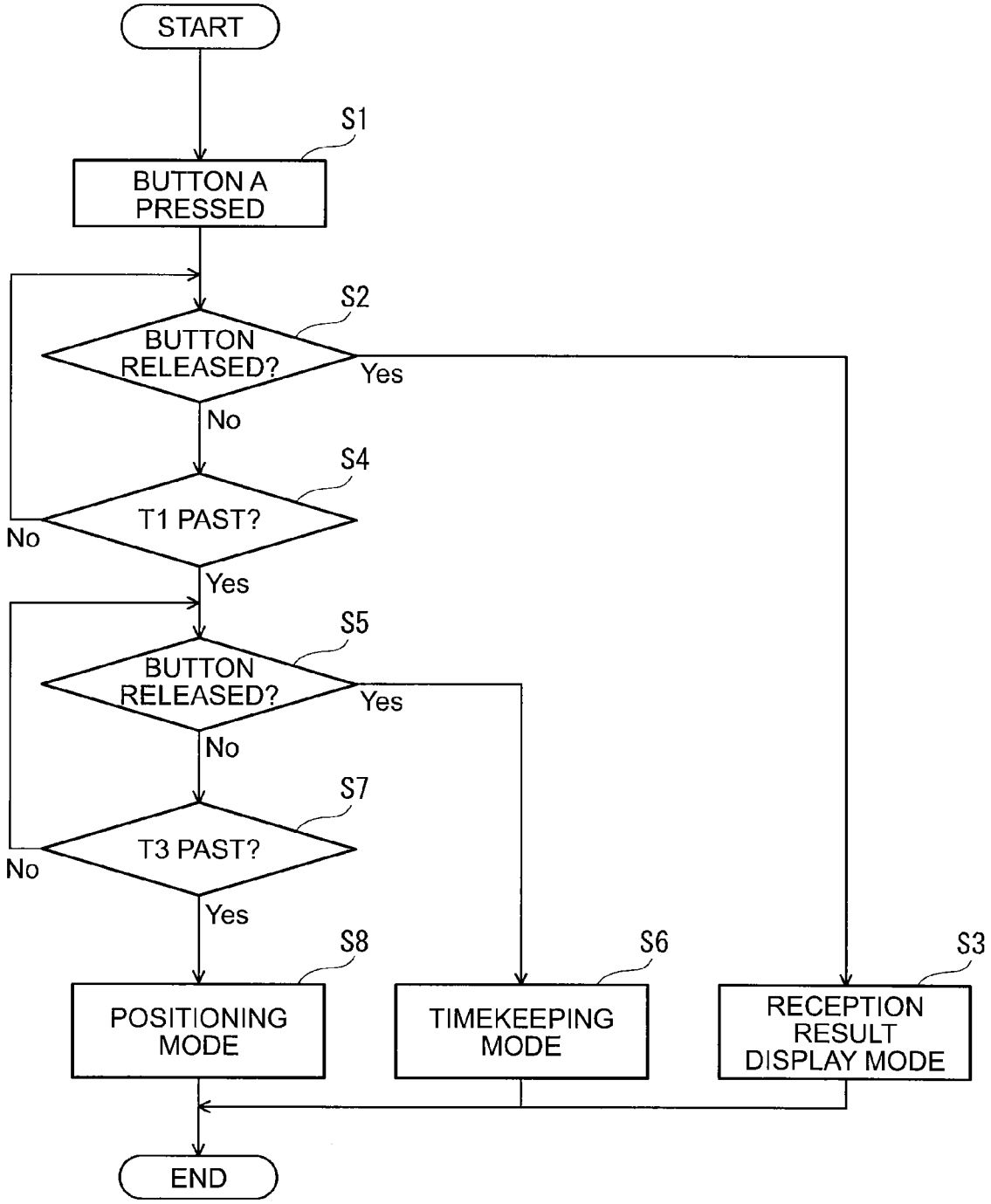
FIG. 5 is a flow chart of the reception process of the wristwatch according to this embodiment.

FIG. 5 is a flow chart showing the processes executed in each operating mode by the control unit 30. The operation performed when button A 6, which is an external operating member in the accompanying claims, is operated is described below.

When the user presses button A 6 (S1), the depression state detector 31 of the control unit 30 detects that the button A 6 was pressed, and the mode setting unit 32 counts the time (operating time) that the button remains depressed. The operating time display control unit 354 of the display control unit 35 jumps the second hand 133 to the 0 position when button A 6 is first pressed, and then moves the second hand 133 in seconds according to the operating time.

The mode display control unit 353 also moves the first small hand 141 to the I marker.

Next, the wristwatch 1 determines if the button A 6 was released (S2). More specifically, when the depression state detector 31 determines that the button A 6 was released, the mode setting unit 32 acquires the operating time to when the button was released as the continuous input time T. The mode setting unit 32 then determines if the continuous input time T is a value within the first input period (the time from 0 to T1 seconds).

If S2 returns Yes, that is, the mode setting unit 32 determines the continuous input time T is a value within the first input period, the mode setting unit 32 sets the operating mode to the reception result display mode. As a result, the wristwatch 1 executes the process corresponding to the reception result display mode (S3).

In step S3 the result display control unit 355 of the display control unit 35 references the reception result stored in the reception result memory unit 264, and if the reception result of the last reception process was a success, moves the second hand 133 to the Y marker on the dial 2. However, if the result of the reception process was failure, the result display control unit 355 moves the second hand 133 to the N marker on the dial 2.

Note that the time that the reception result is displayed (result display time) by the reception result display mode could be a time that is set by the user or a preset specific time. While the reception result is displayed by the result display control unit 355, the mode display control unit 353 holds the hour hand 131 at the I marker. After the result display time ends, the time display control unit 351 drives the display drive unit 221 and returns to the normal time display mode.

However, if S2 returns No, that is, the depression state detector 31 determines that the button has not been released, the mode setting unit 32 determines if the operating time is greater than time T1, which is the maximum length of the first input period (S4).

If the mode setting unit 32 returns No in S4, step S2 repeats.

If the mode setting unit 32 returns Yes in S4, the mode display control unit 353 moves the first small hand 141 to the II marker.

The mode setting unit 32 then determines if the button A 6 was released (S5). More specifically, as in step S2, the mode setting unit 32 gets the continuous input time T, and determines if this continuous input time T is a value within the second input period (the time from time T1 to time T2 seconds).

If the mode setting unit 32 returns Yes in step S5, the operating mode is set to the timekeeping mode, and the wristwatch 1 executes the process corresponding to the timekeeping mode (S6).

In step S6 the reception control unit 33 controls the GPS device 25 in the timekeeping mode to start the satellite signal reception process. The reception control unit 33 then determines if time information was acquired in a set time. This set time is, for example, from 30 seconds to 1 minute, or other time sufficient to receive the time information. Note that the mode display control unit 353 holds the first small hand 141 at the same position during the reception process. More specifically, the first small hand 141 points to the II marker indicating that the operating mode is the timekeeping mode during the reception process in the timekeeping mode.

When the GPS device 25 succeeds in receiving the time information, the timekeeping mode adjustment unit 341 adjusts the internal time information based on the time information contained in the received satellite signal. After the time adjustment process ends, the time display control unit 351 drives the hands 3, first small hand 141, and second small hand 151 based on the adjusted internal time and returns to the normal time display mode.

If the mode setting unit 32 returns No in step S5, that is, if it determines that the button was not released, the mode setting unit 32 determines if the operating time exceeds time T2, which is the maximum length of the second input period (S7).

If the mode setting unit 32 returns No in S7, step S5 repeats.

If in step S7 the mode setting unit 32 returns Yes, the mode display control unit 353 moves the first small hand 141 to the III marker.

If the operating time exceeds time T2, the mode setting unit 32 determines that the continuous input time T is a value in the third input period and sets the operating mode to the positioning mode, and the wristwatch 1 executes the process corresponding to the positioning mode (S8).

In step S8 the reception control unit 33 controls the GPS device 25 in the positioning mode and starts the satellite signal reception process.

The reception control unit 33 then determines if the positioning information and time information were successfully received in the set time. This set time is, for example, from 30 seconds to 1 minute, or other time sufficient to receive the positioning information. Note that the mode display control unit 353 holds the first small hand 141 at the same position during the reception process. More specifically, the first small hand 141 points to the III marker indicating that the operating mode is the positioning mode during the reception process in the positioning mode.

If the GPS device 25 succeeds in receiving the positioning information and time information, the positioning mode adjustment unit 342 gets the positioning information and time information contained in the received satellite signals, and calculates the current position. The positioning mode adjustment unit 342 then references the time difference information stored in the ROM 261, and gets the time difference at the current position. The positioning mode adjustment unit 342 then calculates the standard time at the current position (local time) based on the acquired time information and time difference, and adjusts the internal time information. After the time adjustment process ends, the time display control unit 351 drives the hands 3, first small hand 141, and second small hand 151 based on the adjusted internal time and returns to the normal time display mode.

Note that when the reception process and time adjustment process are executed in the positioning mode, the position display control unit 352 could execute a process that drives the first small hand 141 and second small hand 151 based on the latitude and longitude of the calculated current position, and displays the current position with the first subdial 4 and second subdial 5.

Effect of the Embodiment

As described above, the mode setting unit 32 of a wristwatch 1 according to this embodiment of the invention switches between a timekeeping mode and positioning mode according to the continuous input time that a button A 6 is pressed continuously. When the timekeeping mode is set, the reception control unit 33 gets time information from the satellite signals from one or more GPS satellites 10, and the timekeeping mode adjustment unit 341 of the time adjustment unit 34 adjusts the internal time information based on this time information. When the positioning mode is set, the reception control unit 33 gets time information and positioning information from three or more GPS satellites 10, and the positioning mode adjustment unit 342 of the time adjustment unit 34 adjusts the internal time information from the acquired time information.

This configuration does not require plural external operating members to switch between the timekeeping mode and positioning mode, and thus simplifies the construction. More particularly, providing a plurality of external operating members for a plurality of functions in a wristwatch 1 having a plurality of functions such as described in this embodiment, such as also displaying positioning information, complicates construction, increases the size of the wristwatch 1, and complicates operation. However, because this embodiment of the invention enables changing between two operating modes, timekeeping and positioning, using a single external operating member, specifically using only button A 6, timepiece construction can be simplified and the wristwatch 1 can be made smaller.

The continuous input time for setting the operating mode to the timekeeping mode is shorter than the continuous input time for setting the positioning mode in the wristwatch 1 according to this embodiment of the invention. Because this configuration enables more quickly starting the process of setting the time in the timekeeping mode, which is used more frequently, with a shorter continuous input time, the convenience of the wristwatch 1 can be improved.

When the positioning mode is set by the mode setting unit 32 in the wristwatch 1 according to this embodiment, the positioning mode adjustment unit 342 of the time adjustment unit 34 calculates the current position based on the acquired positioning information, gets the time difference at the current position, and based on this time difference and the acquired time information, calculates the local time at the current position and adjusts the internal time information. As a result, when the user travels to a location in a different time zone, the time can be adjusted to the local time at the destination, and wristwatch 1 convenience can be improved.

The mode setting unit 32 according to this embodiment can also select a reception result display mode when the continuous input time is within a first input period. In this reception result display mode, the result display control unit 355 of the display control unit 35 references the reception result of the last reception process stored in the reception result memory unit 264, moves a hand 3 (second hand 133) to the Y marker on the dial 2 when the reception result is that reception succeeded, and moves the hand 3 (second hand 133) to the N marker on the dial 2 when reception fails.

As a result, this embodiment can display the last reception result, and the user can easily check the reception result and determine whether to adjust the time in the timekeeping mode or the positioning mode, for example.

In addition, because the reception result display mode, timekeeping mode, and positioning mode are set based on the continuous input time, which is the time that the button A 6 is pressed continuously, there is no need to provide separate external operating members to set each operating mode, and the construction can be simplified as described above.

The continuous input time for setting the reception result display mode is shorter than the continuous input time for setting the timekeeping mode or positioning mode.

More specifically, because adjusting the time in the timekeeping mode or positioning mode usually occurs after checking whether or not the last reception process and time adjustment process succeeded, the reception result display mode is used more frequently than time adjustment by the timekeeping mode or positioning mode. Therefore, by setting the continuous input time for the frequently used reception result display mode shorter than the continuous input time for the timekeeping mode or positioning mode, user convenience can be improved.

In this embodiment the operating time display control unit 354 moves the second hand 133 of the hands 3 to the 0 second position on the dial 2 when the button A 6 is pressed, and moves the second hand 133 according to the time that the button A 6 continues to be pressed. In other words, the dial 2 and hands 3 function as an operating time display unit in the accompanying claims.

As a result, the user can easily know the operating time when the button A 6 is pressed, such as how long to press the button to set the operating mode desired by the user, and the operating state of the button A 6 (such as if the depression state detector 31 recognizes that the button A 6 was pressed).

When the button A 6 is pressed in this embodiment, the mode display control unit 353 moves the first small hand 141 to the I marker in the second area 144. The mode display control unit 353 then moves the first small hand 141 to the II marker in the second area 144 when the operating time exceeds the maximum time T1 of the first input period. The mode display control unit 353 also moves the first small hand 141 to the III marker in the second area 144 after the maximum time T2 of the second input period passes. In other words, the mode display control unit 353 displays on the display unit 222 the operating mode that can be selected according to the operating time of the button A 6

As a result, the user can confirm the operating mode that can be selected from the first small hand 141. In addition, by displaying the operating mode that can be selected with the operating time display control unit 354 in addition to displaying the operating time with the mode display control unit 353, this embodiment enables comparing and checking the operating mode corresponding to the operating time of the button A 6.

The mode display control unit 353 in this embodiment holds the first small hand 141 at the same display position while the reception control unit 33 is executing the reception process, and while the result display control unit 355 is displaying the reception result. The user can therefore easily know with which operating mode the process that is currently being executed is associated.

Variations

The invention is not limited the embodiment described above.

For example, the foregoing embodiment describes an example in which the mode display control unit 353 displays the operating mode corresponding to the operating time, the mode display control unit 353 displays the operating mode of the executing process, and the operating time display control unit 354 displays the operating time, but a configuration that displays only one or two of these instead of all is also conceivable.

For example, the operating time of the button A 6 can be known by the operating time display control unit 354 displaying the operating time even when the mode display control unit 353 does not display the operating mode corresponding to the operating time. In this case, by the mode display control unit 353 displaying the operating mode while the reception process and reception result display process execute, the user can check which operation is in progress.

The foregoing embodiment describes the dial 2 and hands 3 (second hand 133) functioning as the operating time display unit in the accompanying claims, but the invention is not so limited. For example, the second subdial 5 could be made to function as the operating time display unit.

This also applies to the set mode display unit, the operating mode display unit, and the reception result display unit, the content of which could be displayed by any of the parts of the display unit 222. For example, the set mode display unit and the operating mode display unit could be rendered by the dial 2 and a hand 3 by providing the I, II, and III markers denoting the operating mode on the dial 2 and a hand 3 (second hand 133) pointing at the appropriate marker.

The mode setting unit 32 in the foregoing embodiment executes a process that sets a timekeeping mode as a first mode, the positioning mode as a second mode, and the reception result display mode as a third mode according to the continuous input time, but the invention is not so limited. For example, the mode setting unit 32 could set either of only two modes, such as the timekeeping mode as the first mode and the positioning mode as the second mode. A configuration enabling setting even more operating modes according to the continuous input time of the button A 6 is also conceivable.

When setting the operating mode with the mode setting unit 32, the continuous input time corresponding to the timekeeping mode is shorter than the continuous input time corresponding to the positioning mode, that is, the third input period is set after the second input period, but the invention is not so limited. For example, the third input period could be set before the second input period. In this case, the user can easily adjust the time with high precision in the positioning mode with a short operating time, and the timekeeping mode could be used only when satellite signal reception conditions are poor.

Likewise, the first input period corresponding to the reception result display mode could be set after the second input period and third input period corresponding to the timekeeping mode and positioning mode.

This embodiment describes using button A 6 as the external operating member for selecting the reception result display mode, timekeeping mode, and positioning mode, but the button B 7 could be used instead, for example.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The electronic timepiece according to the invention is not limited to analog timepieces having hands, and can also be applied to hybrid timepieces having both analog hands and a digital display, and to digital timepieces having only a digital display. The invention is also not limited to wristwatches, and can be adapted to pocket watches and other types of portable timepieces, and electronic devices including cellular telephones, digital cameras, personal navigation devices, motor vehicle navigation devices, and other types of mobile information terminals having the electronic timepiece of the invention.

Preferred configurations and methods of achieving the invention are described above, but the invention is not so limited. More specifically, the invention is shown in the figures and described above with particular reference to a specific embodiment, but other variations of the form, materials, quantities, and other details of the configuration will be obvious to one with ordinary skill in the related art without departing from the technical scope of the invention and the accompanying claims. Such variations are not to be regarded as a departure from the spirit and scope of the invention, and all such modifications as would be obvious to one skilled in the art are intended to be included within the scope of the following claims.

The entire disclosure of Japanese Patent Application No. 2011-187478, filed Aug. 30, 2011 is expressly incorporated by reference herein.

What is claimed is:

1. An electronic timepiece comprises:

an external operating member;

a mode setting unit that sets an operating mode of the timepiece based on an input operation of the external operating member;

a reception unit that receives a satellite signal transmitted from a positioning information satellite;

a reception control unit that controls operation of the reception unit and receives the satellite signal based on the operating mode;

a time adjustment unit that adjusts an internal time information based on the satellite signal received by the reception unit; and an operation mode display unit that displays the operation mode being executed:

wherein the mode setting unit sets the operating mode to a first mode that receives a satellite signal from one or more positioning information satellites and adjusts the internal time information based on time information contained in the received satellite signal, when a continuous input time for which the external operating member is operated continuously is greater than a first time and less than or equal to a second time, and a second mode that receives satellite signals from three or more positioning information satellites and adjusts the internal time information based on time information and positioning information contained in the received satellite signals, when the continuous input time is greater than the second time, the second time being greater than the first time; and wherein the operation mode display unit displays that the first mode is being executed when the external operating member is operated for at least the fist time and changes to display that the second mode is being executed when the external operating member is operated for at least the second time.

2. The electronic timepiece described in claim 1, wherein:

when the operating mode set by the mode setting unit is the second mode, the time adjustment unit calculates a standard time at the current location of the electronic timepiece and sets the internal time information based on the time information and positioning information contained in the satellite signals.

3. The electronic timepiece described in claim 1, further comprising:

a reception result storage unit that stores a reception result indicating whether or not satellite signal reception by the reception unit succeeded;

a reception result display unit that displays the reception result; and a result display control unit that causes the reception result display unit to display the reception result;

wherein the mode setting unit sets a third mode that causes displaying the reception result stored in the reception result storage unit based on the continuous input time as the operating mode, and when the third mode is set as the operating mode, the result display control unit displays the reception result on the reception result display unit.

4. The electronic timepiece described in claim 3, wherein:

the continuous input time when the mode setting unit sets the third mode as the operating mode is shorter than the continuous input time when the mode setting unit sets the first mode or the second mode as the operating mode.

5. The electronic timepiece described in claim 1, further comprising:

an operating time display unit that displays the continuous input time.

6. An electronic device comprising the electronic timepiece described in claim 1.

* * * * *